United States Patent [19]

Ballarati et al.

[11] Patent Number: 4,669,158

[45] Date of Patent: Jun. 2, 1987

[54] METHOD FOR PREPARING WARP WOUND ON BEAMS, STARTING FROM A SERIES OF CONTINUOUS, PARTIALLY-DRAFTED THERMOPLASTIC YARNS

[75] Inventors: Vito Ballarati, Cuggiono; Franco Tajana, Como, both of Italy

[73] Assignee: Val Lesina S.p.A., Como, Italy

[21] Appl. No.: 768,940

[22] Filed: Aug. 26, 1985

Related U.S. Application Data

[63] Continuation of Ser. No. 560,848, Dec. 13, 1983, abandoned.

[30] Foreign Application Priority Data

Oct. 27, 1983 [IT] Italy ..... 23476 A/83

[51] Int. Cl.[4] ..... D02H 5/02; D02J 1/08

[52] U.S. Cl. ..... 28/172; 28/220; 28/246

[58] Field of Search ..... 28/172, 178, 179, 180, 28/181, 220, 246, 258

[56] References Cited

U.S. PATENT DOCUMENTS

| | | | |
|---|---|---|---|
| 2,956,328 | 10/1960 | Faw | 28/178 |
| 3,099,064 | 7/1963 | Haynes | 28/258 X |
| 3,329,757 | 7/1967 | Johnson | 28/258 X |
| 3,406,437 | 10/1968 | Tew . | |
| 3,434,189 | 3/1969 | Buck et al. | 28/220 X |
| 3,454,998 | 7/1969 | Satterwhite | 28/220 X |
| 3,497,910 | 3/1970 | Maeda et al. | 28/246 X |
| 3,625,735 | 12/1971 | Fernstrom et al. | 28/220 X |
| 3,973,386 | 8/1976 | Gorrafa | 28/220 X |
| 4,025,993 | 5/1977 | Kuroda . | |
| 4,096,611 | 6/1978 | Heyner | 28/220 |
| 4,407,767 | 10/1983 | Seaborn | 28/178 X |

FOREIGN PATENT DOCUMENTS

| | | | |
|---|---|---|---|
| 0037118 | 10/1981 | European Pat. Off. | 28/220 |
| 2437650 | 2/1976 | Fed. Rep. of Germany . | |
| 3018373 | 11/1981 | Fed. Rep. of Germany | 28/172 |
| 2307072 | 11/1976 | France . | |
| 2404066 | 5/1979 | France | 28/178 |
| 46-17298 | 3/1971 | Japan | 28/172 |
| 46-25534 | 7/1971 | Japan | 28/246 |
| 1576355 | 10/1980 | United Kingdom | 28/172 |
| 2075371 | 11/1981 | United Kingdom . | |

*Primary Examiner*—Robert R. Mackey

*Attorney, Agent, or Firm*—Stevens, Davis, Miller & Mosher

[57] ABSTRACT

A procedure for the drafting and interlacing of a series of continuous, thermoplastic yarns, consisting of filaments which are substantially parallel to one another, in the manufacture of warp wound on beams.

4 Claims, 1 Drawing Figure

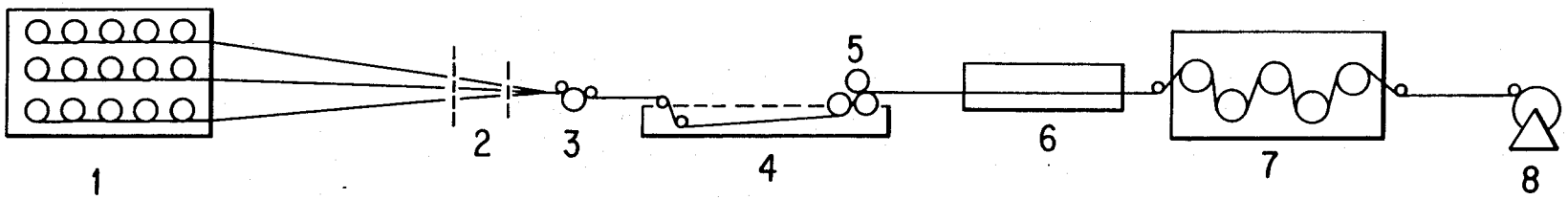
1
2
3
4
5
6
7
8

METHOD FOR PREPARING WARP WOUND ON BEAMS, STARTING FROM A SERIES OF CONTINUOUS, PARTIALLY-DRAFTED THERMOPLASTIC YARNS

This application is a continuation of application Ser. No. 560,848, filed Dec. 13, 1983, now abandoned.

This invention concerns a method for the preparation of warps or warp sections wound on beams, consisting of continuous thermoplastic yarns which are completely drafted and interlaced and suitable for use on looms for the production of textile products of all types.

The method is characterized by the fact that a series of continuous thermoplastic yarns, having filaments which are substantially parallel to each other and not completely drafted, are simultaneously drafted when immersed in a thermostatic liquid and that the yarns are subjected to an interlacing process prior to final winding.

The known processes for the preparation of continuous, thermoplastic-polymer yarns for textile use involve spinning the filments from the molten polymer, cooling them, combining them to form the yarn and then drafting the yarn.

Drafting orients the molecules of the filaments and thus gives them the required physical and mechanical characteristics for making them suitable for textile use. There are two techniques used in the known processes for obtaining drafted yarns. In this invention, we are considering the more pertinent of the two. According to this more pertinent process, the yarn produced during spinning is wound onto spools in an incompletely-drafted state. Complete drafting of the yarn takes place in a subsequent phase by means of a special drafting or drafting-twisting machine, which has several positions, each of which acting on one individual yarn. These machines do not readily permit the obtaining of perfectly constant yarn characteristics, presumably due to the fact that each yarn is treated individually and is therefore subjected to a particular temperature or particular mechanical setting regarding its particular machine position.

As is well known, there are many cases where, in order to make the yarns suitable for loom use, where the mechanical stresses imposed in the loom operation could break the individual filaments, the yarns coming off the drafting or drafting-twisting machine are subjected to a sizing operation, which consists of impregnating the filaments with a special sizing agent, in accordance with this process: The beams, upon which the previously-warped yarns have been wound, are mounted on support creels. The properly-arranged and parallel yarns are passed through a special apparatus which includes an impregnation vat and squeezing rollers. The yarns are then dried by means of hot air, infrared radiation or heated cylinders, after which they are wound onto beams by a winding machine.

A recent method, described by the Applicant's European Pat. No. 91549, shows the possibility of combining the two separate phases, drafting and sizing, into a single phase, thus providing obvious technical and economical advantages.

As stated previously, the method given in this invention allows the use of a yarn which is not completely drafted—as obtained by spinning in accordance with the known technique—as the starting yarn for the preparation of the aforesaid warps or warp sections for textile use.

This present invention constitutes an additional technical development over and above that described in the Applicant's afore-mentioned European Pat. No. 91549. It consists in the elimination of the need for a sizing agent in the termostatic bath. The sizing treatment is replaced by a interlacing process, which is applied to each individual yarn at the exit side of the thermostatic bath. It can be located, however, even before the drafting phase; for example, on the feed creel.

The FIGURE illustrates a schematic flow chart showing the process of the present invention. The referenced numerals refer to the following:

1=feed creel
2=guide
3=feed rollers
4=tank filled with thermostatic liquid
5=traction rollers
6=fluid jet interlacing treatment
7=hot cylinders (thermal stabilizing of the yarns)
8=winding machine The process which is the object of this invention includes the following operations:

The not less than 24 cops mounted on the feed creel 1 are each wound with yarn coming from the spinning machine. The yarn is not completely drafted. The yarns unwind from the cops at a constant tension and are kept parallel to each other by means of a comb guide 2. The yarns pass through a feed and support roller system 3. The rollers 3 have a constant peripheral velocity. Next, the yarns pass into a vat 4 of thermostatic liquid, which is kept at a certain temperature so that the filaments of the yarn can be drafted. The yarn leaves the vat 4 and passes through a system of traction rollers 5 which have a constant peripheral velocity that is greater than that of the feed rollers 5. The rollers 5 of the traction system are also designed for squeezing out any excess water adhering to the yarn. The desired drafting and molecular orientation of the individual filaments is obtained, between the feed 3 and traction 5 rollers, by means of the combined action of the differential peripheral velocities, which generates tension, and the softening of the polymer, due to the heat of the bath 4. Following this drafting operation, the yarns then pass through interlacing devices 6, which are of known design and which are used to entangle the filaments by the action of high-speed fluid jets. These devices are arranged in banks and, there being one for each yarn, the yarns are acted upon individually. In certain cases, it is preferable to subject the yarns to a preliminary interlacing treatment prior to the drafting operation. In these cases, the interlacing devices can be conveniently mounted on the feed creel.

After the drafting bath and either before or after the interlacing phase, the yarns can be dried by passing them through suitable ovens and/or heated cylinders 7.

The yarn is then wound onto beams or similar devices, using a winding machine 8.

Another possibility for feeding the apparatus consists in winding the yarns onto beams, small beams, large reels, or any such similar device, using a winding machine, and then feeding from these, rather than directly from the spools mounted on the creel.

In this case, it is also possible to unite several section beams at the entrance to the feed rollers from the drafting phase. The new method described in this invention—whereby several continuous thermoplastic yarns are arranged parallel to each other, drafted simultaneously and then interlaced—permits a considerable cost savings, as compared to the traditional process mentioned earlier. This is because the process permits the complete elimination of the preliminary drafting phase in which each individual yarn is drafted, either before or after the spinning operation, by using a drafting or drafting-twisting machine.

Compared to the procedure described in the Applicant's European Pat. No. 91549, this invention provides the considerable advantage of being able to do away with the need for a sizing agent, substituting it—in practical terms—with a interlacing process.

In general, it has been found preferable to carry out interlacing when the yarn material is still wet, because better filament interconnection is obtained in this manner.

Another outstanding advantage provided by this invention consists in the possibility of substituting the more usual types of interlacing devices with known voluminizing devices, such as the known Taslan process, for example, which uses a high-velocity fluid jet. These devices obviously provide interlacing and voluminization at the same time. The very great advantage of being able to combine the drafting operation, the voluminization operation and the preparation of warps or warp sections on weaving beams can, therefore, be obtained. With known procedures, in fact, the drafted yarn is fed into costly voluminizing machines.

This invention also provides another outstanding advantage; that is, a further reduction of operational cost because of the elimination of the need for desizing the end product, which would otherwise have to be desized by using costly desizing processes.

These advantages are obtained, furthermore, without having to substantially modify the standard systems of operation, these remaining essentially the same.

After having carried out a long series of tests, we have shown that the fabrics woven with the yarns produced with our new method have excellent compactness and uniformity characteristics.

This invention is further illustrated by the following non-limiting examples:

EXAMPLE 1

1000 cops of partially-oriented, lucid, polyester yarn (POY), having the following characteristics, are loaded onto a warping feed creel.

Count: 127 Dtex
Number of filaments: 24
Filament cross-section: circular
Breaking load: 330 grams
Ultimate elongation: 156%
Theoretical residual draft: 1.628 (127/78)

The yarns are interlaced in the feed creel and then warped under a tension of 10 grams, passing through the blades of a rectilinear comb.

The yarns are anchored and dragged with a tension of 10 grams by a 3-roller system, which rotate together at a constant peripheral speed of 130 meters/min.

The yarns are then immersed in a vat of demineralized water, which is held at a constant temperature of 80° C.

A system of three drafting and squeezing cylinders, which rotate together at a constant peripheral speed of 220 meters/min., acts simultaneously on all the yarns, giving them a draft to feed ratio of 1.692.

Upon leaving the drafting and squeezing cylinders, the yarns pass through the interlacing jets, which are fed by compressed air under 3 Atm of pressure.

The interlaced yarns are then dried and set by coming in contact with seven rotating cylinders, which are heated by steam and kept at temperature from 150° C., the first cylinder, to 90° C., the last.

The speed of the heated cylinders is kept slightly under 220 meters/min, so as to allow a certain amount of shrinkage of yarn length before setting.

When leaving the setting cylinders, the yarns are wound on beams measuring 1800 millimeters in height and in six sections, each measuring 16,000 meters in length.

The average characteristics of the drafted and interlaced yarns thus obtained are as follows:

Count: 82 Dtex
Breaking strength: 321 grams
Ultimate elongation: 34%
Shrinkage in boiling water: about 2%

During the next phase, the six sections are wound on weaving beams measuring 1550 millimeters in height, making a total of 6000 strands of yarn.

A beam is loaded onto a water loom and wefted with texturized polyester yarn having a count of 78 Dtex and 24 filaments, at a speed of 410 beats/min., with a cloth weave and a density of 24 wefts/centimeter.

The fabric is then dyed in a jet-type cord-dyeing machine. Disperse Blue Color Index 056 dispersed dye is used.

The fabric is centrifuged, dried in hot air, passed through a stenter machine and thermo-fixed at 180° C. at 25 meters/min. The obtained fabric has a height of 140 centimeters.

Specular inspection of a black table, for revealing fabric defects, reveals high uniformity and compactness of the warped yarns with lucid yarns being totally absent.

EXAMPLE 2

The same procedure is used as in the foregoing example except that 1160 cops of the same yarn are loaded onto the creel and eight weaving beams, having a height of 44 inches each, are wound with 15,000 meter warp lengths each.

The eight weaving beams are loaded into a warp-type, rectilinear knitting frame.

Dyeing operations are finally carried out on the obtained knitted fabric as done in the foregoing example.

Examination by passing the fabric under the specular instrument reveals perfect evenness of weave and, in particular, perfect dyeing homogeneity.

We claim:

1. A process for the preparation of warps of continuous, synthetic completely-drafted yarns of thermoplastic material selected from the group consisting of polyester, polyamide, polyethylene and polypropylene, said warps being wound on weaving beams, suitable for all types of loom-produced textiles, in which process a series of at least 24 yarns made of substantially parallel and partially drafted filaments are simultaneously and contemporaneously drafted when immersed in a vat containing a thermostatic liquid in the absence of a sizing agent, and subsequently subjecting said series of yarns to an interlacing treatment using a fluid jet and then to a thermosetting treatment, said interlacing treatment being carried out while the yarns are still wet.

2. A process, in accordance with claim 1, where the yarns, which are partially drafted, are subjected to a preliminary interlacing process prior to being drafted.

3. A process, in accordance with claim 1, where the interlacing process is carried out by means of a device which also causes the voluminization of the yarn.

4. A process, in accordance with claim 2, where the preliminary interlacing is obtained by means of the devices mounted directly onto the feed creel.

* * * * *